US011585341B2

(12) United States Patent
Unno

(10) Patent No.: US 11,585,341 B2
(45) Date of Patent: Feb. 21, 2023

(54) PUMP DEVICE

(71) Applicant: JTEKT CORPORATION, Osaka (JP)

(72) Inventor: Keisuke Unno, Toyota (JP)

(73) Assignee: JTEKT CORPORATION, Kariya (JP)

( * ) Notice: Subject to any disclaimer, the term of this patent is extended or adjusted under 35 U.S.C. 154(b) by 319 days.

(21) Appl. No.: 16/801,330

(22) Filed: Feb. 26, 2020

(65) Prior Publication Data

US 2020/0291937 A1 Sep. 17, 2020

(30) Foreign Application Priority Data

Mar. 13, 2019 (JP) ..... JP2019-045396

(51) Int. Cl.
*F04C 15/06* (2006.01)
*F04C 2/08* (2006.01)
*F04C 28/24* (2006.01)

(52) U.S. Cl.
CPC ..... *F04C 2/084* (2013.01); *F04C 28/24* (2013.01); *F04C 15/06* (2013.01); *F04C 2240/30* (2013.01); *F04C 2240/40* (2013.01)

(58) Field of Classification Search
CPC .... F04C 29/12; F04C 2250/102; F04C 2/103; F04C 2/084; F04C 2/344–3568; F04C 15/06; F04B 53/16; F04B 53/007; F04B 39/123; F04B 39/125; F04B 39/12; F04B 1/122; F04B 1/141; F04B 1/188; F04B 1/2014; F04B 1/2021
USPC ..... 418/171
See application file for complete search history.

(56) References Cited

U.S. PATENT DOCUMENTS 2,380,783 A 7/1945 Painter
4,240,567 A * 12/1980 Gardner ..... F04C 15/06 222/146.5
4,596,519 A 6/1986 Tuckey
4,897,025 A * 1/1990 Negishi ..... F04C 15/06 418/189
2004/0022659 A1* 2/2004 Kano ..... F04C 29/12 418/132

(Continued)

FOREIGN PATENT DOCUMENTS

DE 39 00 263 A1 7/1990
EP 2 078 859 A2 7/2009

(Continued)

OTHER PUBLICATIONS

Extended European Search Report dated Aug. 6, 2020 in Patent Application No. 20160034.3, 8 pages.

*Primary Examiner* — Thomas Fink
(74) *Attorney, Agent, or Firm* — Oblon, McClelland, Maier & Neustadt, L.L.P.

(57) ABSTRACT

A pump device includes a rotating body, a pump housing including a suction port and a discharge port, and a relief valve. In the pump device, a fluid is sucked from the suction port and discharged from the discharge port by rotation of the rotating body. The relief valve includes a valve body and a biasing member. The discharge port includes an one end in a direction in which the discharge port extends. The one end is shallower than a middle portion of the discharge port. The pump housing includes a relief flow path through which the fluid flows when the relief valve opens. The relief flow path is provided so as to be open to a groove bottom surface of the one end of the discharge port.

8 Claims, 5 Drawing Sheets

(56) References Cited

U.S. PATENT DOCUMENTS

| | | | | |
|---|---|---|---|---|
| 2008/0206078 | A1 | 8/2008 | Yamamoto et al. | |
| 2010/0008797 | A1* | 1/2010 | Yukitake ..... | F04C 14/26<br>418/61.3 |

FOREIGN PATENT DOCUMENTS

| | | | |
|---|---|---|---|
| JP | 2008-215087 | A | 9/2008 |
| JP | 2013-241837 | A | 12/2013 |

* cited by examiner

PUMP DEVICE

CROSS-REFERENCE TO RELATED APPLICATION

This application claims priority to Japanese Patent Application No. 2019-045396 filed on Mar. 13, 2019, incorporated herein by reference in its entirety.

BACKGROUND

1. Technical Field

The disclosure relates to pump devices.

2. Description of Related Art

Conventionally, electric pump devices are widely used that are attached to, for example, a transmission case of a vehicle and suck transmission oil from an oil pan to supply the oil to each portion for lubrication, cooling, etc. In such pump devices, a rotor is rotated in an accommodating chamber of a housing by an electric motor that is a driving source. The housing includes a suction port and a discharge port that are open to the accommodating chamber. As the rotor is rotated in the accommodating chamber, oil sucked from the suction port is discharged from the discharge port. Pump devices described in Japanese Unexamined Patent Application Publication No. 2008-215087 (JP 2008-215087 A) and Japanese Unexamined Patent Application Publication No. 2013-241837 (JP 2013-241837 A) include a relief valve that opens when the discharge pressure becomes equal to or higher than a predetermined value to release oil to the low pressure side such that an electric motor is not overloaded due to the discharge pressure becoming too high.

In the pump device (electric oil pump) described in JP 2008-215087 A, a fluid communication hole through which the discharge and suction sides of a pump communicate with each other is provided in a spool that is a valve body. This spool is biased in a valve closing direction by a coil spring. When the discharge pressure become high, the spool withdraws against the biasing force of the coil spring to allow the discharge and suction sides of the pump to communicate with each other through the fluid communication hole. The coil spring is disposed in a compressed state between the spool and an adjusting screw, and the central axis of the coil spring extends in a direction perpendicular to the rotation axis of the electric motor. The spool advances and withdraws along the central axis of the coil spring according to the discharge pressure.

The pump device (electric pump) described in JP 2013-241837 A includes a pressure receiving body as a valve body at a position facing a discharge port via a flow path, and the pressure receiving body is biased in the valve closing direction toward the discharge port by a coil spring. The pump device includes an opening on the downstream side of the pressure receiving body. The opening opens when the pressure receiving body withdraws by a predetermined amount. When the pressure receiving body withdraws due to a pressure received from the discharge port and the opening opens, a part of fluid in the discharge port is discharged to the outside from the opening. The coil spring is accommodated in a tubular portion of a housing such that the central axis of the coil spring extends parallel to the rotation axis of the electric motor. The coil spring is axially compressed between a plug body that closes one end of the tubular portion and the pressure receiving body.

SUMMARY

For example, a pump device that is attached to a circular opening of a transmission case may not be able to be attached to the transmission case when the central axis of a coil spring is perpendicular to the rotation axis of an electric motor as in the pump device described in JP 2008-215087 A. This is because the coil spring or the adjusting screw projects outward in the radial direction of the pump housing. When a coil spring is disposed such that its central axis extends parallel to the rotation axis of an electric motor as in JP 2013-241837 A, a housing can be inserted into the transmission case through the opening of the transmission case without increasing the opening diameter of the opening of the transmission case. However, since a tubular portion of the housing that accommodates the coil spring protrudes to a large extent in the axial direction parallel to the rotation axis of the electric motor, the tubular portion tends to interfere with constituent members in the transmission case.

The disclosure provides a pump device that can achieve reduction in size.

A pump device according to a first aspect of the disclosure includes: a rotating body that is rotationally driven about a rotation axis; a pump housing including a suction port and a discharge port that are open to an accommodating chamber accommodating the rotating body, the suction port and the discharge port extending in the shape of an arc-shaped groove; and a relief valve that opens when a hydraulic pressure in the discharge port becomes equal to or higher than a predetermined value. In the pump device, a fluid is sucked from the suction port and discharged from the discharge port by rotation of the rotating body. The relief valve includes a valve body and a biasing member that biases the valve body in a valve closing direction. The discharge port includes an one end in a direction in which the discharge port extends, and the one end is shallower than a middle portion of the discharge port. The pump housing includes a relief flow path through which the fluid flows when the relief valve opens. The relief flow path is provided so as to be open to a groove bottom surface of the one end of the discharge port. The valve body and the biasing member of the relief valve and an opening of the relief flow path are arranged in a direction parallel to the rotation axis. The opening is provided in the groove bottom surface.

The disclosure achieves reduction in size of a pump device.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein:

FIG. 3A illustrates the opposite surface of the second housing member from the first housing member, and FIG. 3B illustrates the surface of the second housing member that faces the first housing member;

DETAILED DESCRIPTION OF EMBODIMENTS

An embodiment of the disclosure will be described with reference to FIGS. 1A to 6. The embodiment described below is shown as a specific example suitable for carrying out the disclosure, and in some parts, specifically illustrates various technical matters that are technically preferable. The technical scope of the disclosure is not limited to this specific embodiment.

Figure 1A:
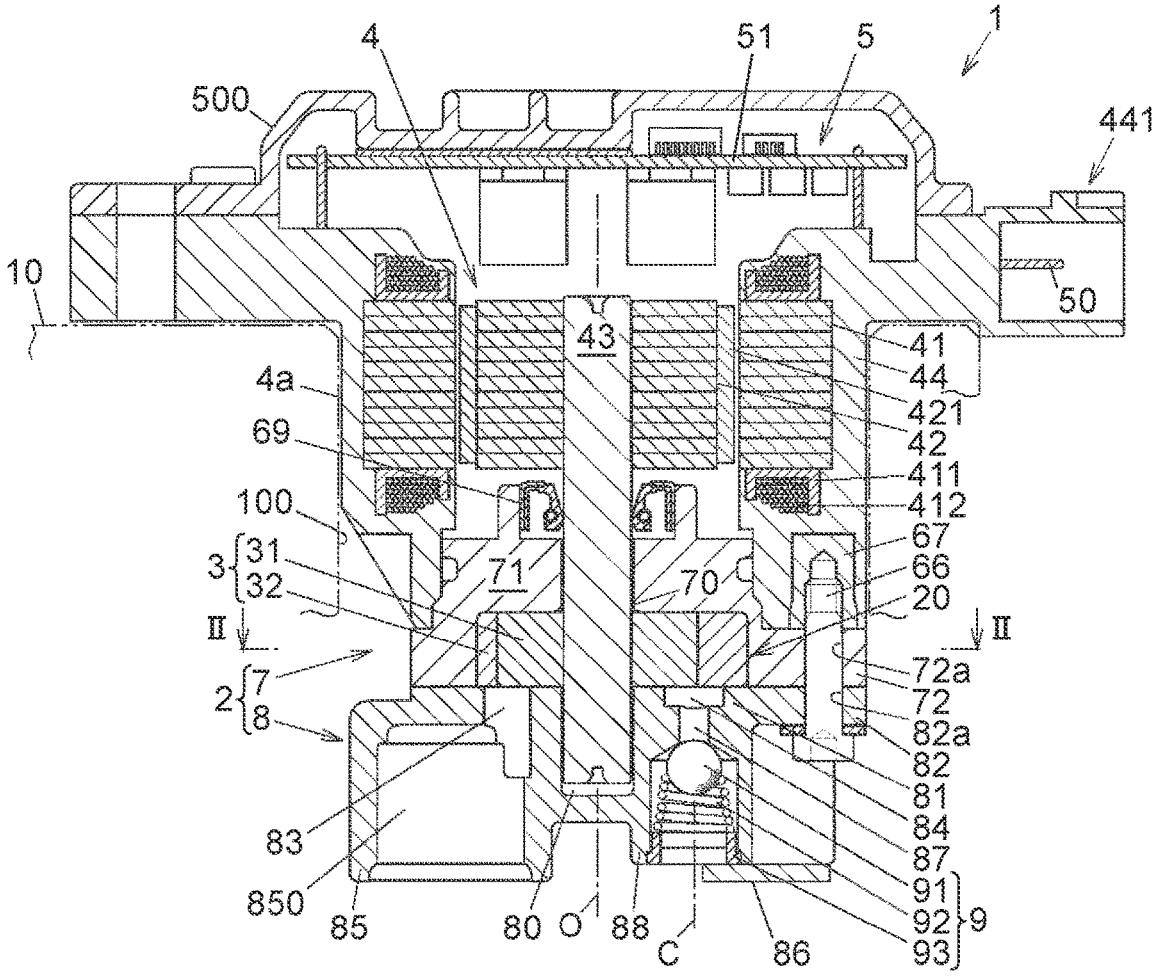
FIG. 1A is a sectional view showing a configuration example of a pump device attached to an opening of a transmission case that is an object to which the pump device is to be attached.
Figure 1B:
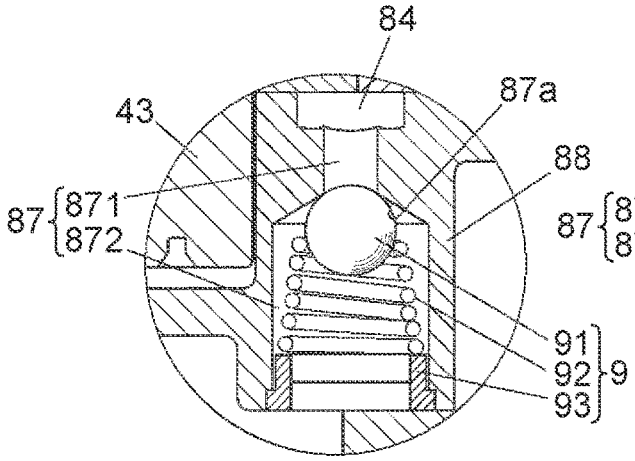
FIGS. 1B and 1C are partial enlarged sectional views of the pump device.
Figure 1C:
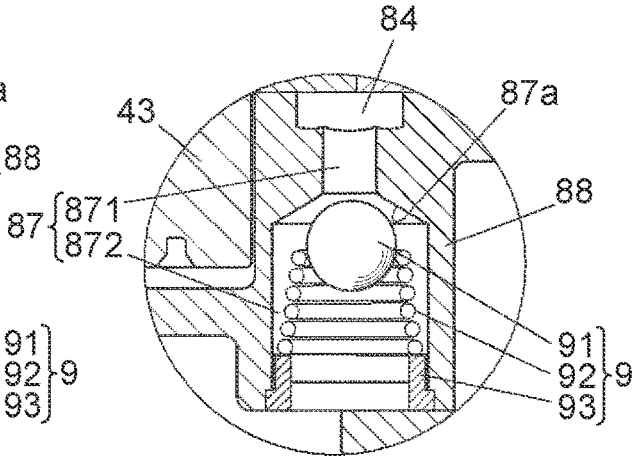
Figure 2:
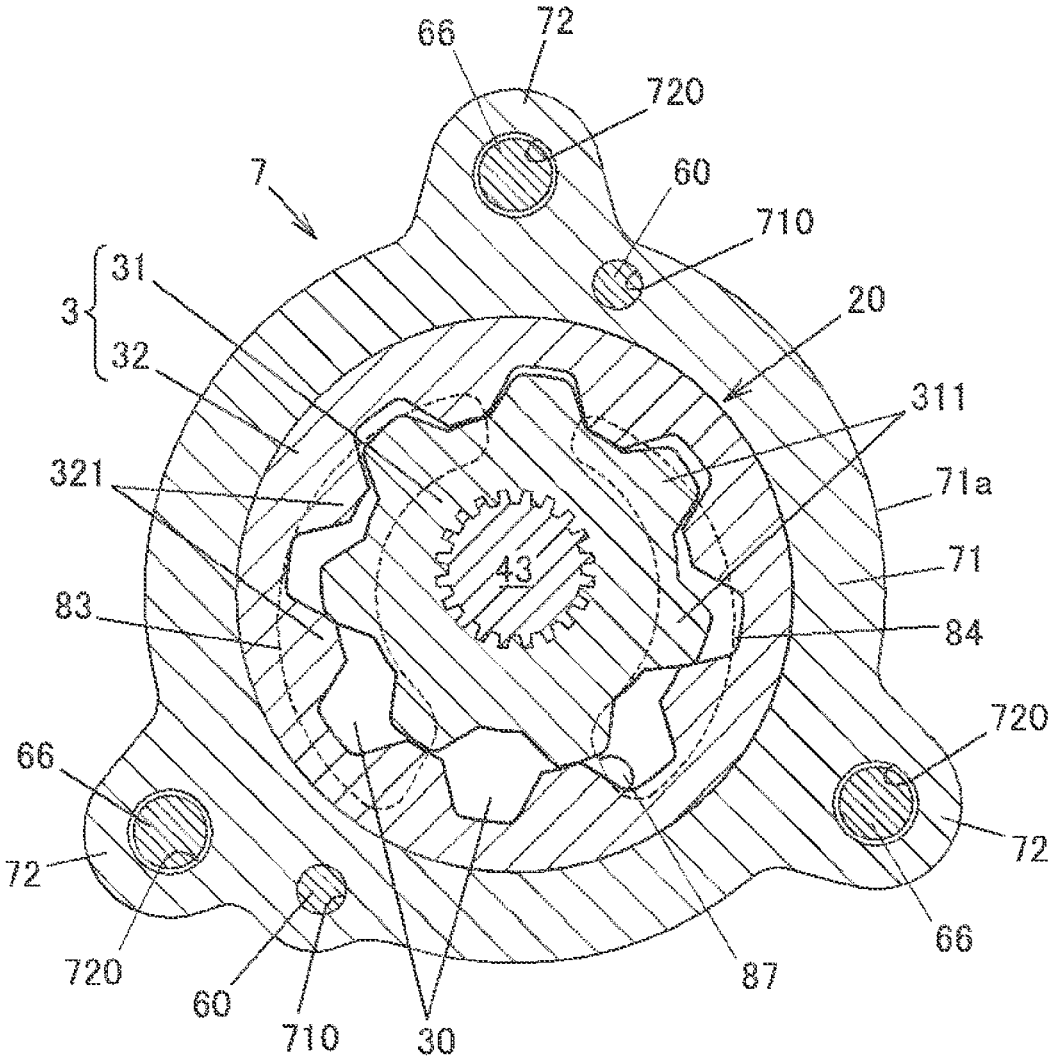
FIG. 2 is a sectional view of the pump device taken along line in FIG. 1A.

FIG. 1A is a sectional view illustrating a configuration example of a pump device 1 attached to an opening 100 of a transmission case 10 that is an object to which the pump device 1 is to be attached. FIGS. 1B and 1C are partial enlarged sectional views of the pump device 1. FIG. 2 is a sectional view of the pump device 1 taken along line II-II in FIG. 1A. In FIG. 1A, the transmission case 10 is shown by hidden outline (long dashed double-short dashed line). The pump device 1 is attached to the transmission case 10 with a part of the pump device 1 inserted in the circular opening 100 of the transmission case 10. In FIGS. 1A to 1C, the lower side of the figures corresponds to the inside of the transmission case 10.

In the present embodiment, the pump device 1 is configured as an electric pump including an electric motor unit (described later) as a driving source. The pump device 1 is mounted on an electric vehicle or what is called a hybrid vehicle including a high power motor such as an interior permanent magnet motor (IPM) as a driving source for moving the vehicle. The pump device 1 sucks oil (transmission oil), which is the fluid of the disclosure, from an oil pan of the transmission case 10 and supplies the oil to an object to which oil is to be supplied. Examples of the object to which oil is to be supplied include the high power motor and a speed change mechanism of a transmission. Oil supplied from the pump device 1 is used to lubricate, cool, or operate the object to which oil is to be supplied, and returns from the object to the oil pan.

The pump device 1 includes a pump housing 2, a pump unit 3, an electric motor unit 4, and a control unit 5. The pump housing 2 includes an accommodating chamber 20. The pump unit 3 includes an inner rotor 31 and an outer rotor 32 that are accommodated in the accommodating chamber 20 of the pump housing 2. The electric motor unit 4 rotationally drives the inner rotor 31. The control unit 5 controls the electric motor unit 4.

The electric motor unit 4 includes a stator core 41, a rotor core 42, a rotor shaft 43, and a motor housing 44. The stator core 41 is made of a soft magnetic metal and includes a plurality of teeth. The rotor core 42 is disposed inwardly of the stator core 41. The rotor shaft 43 is an output rotating shaft and is inserted through the center of the rotor core 42. The motor housing 44 is made of a resin for molding the stator core 41. A plurality of permanent magnets 421 are fixed to the rotor core 42. A coil 412 is wound around the stator core 41 with an insulator 411 interposed therebetween. A three-phase alternating current (AC) motor current is supplied from the control unit 5 to the coil 412. The stator core 41 generates a rotating magnetic field by the motor current supplied to the coil 412. The rotor core 42 rotates so as to follow this rotating magnetic field.

The rotor shaft 43 is rotatably supported by a bearing (not shown) attached to the pump housing 2 and rotates with the rotor core 42. The pump device 1 is attached to the transmission case 10 with bolts, not shown. For example, the pump device 1 is attached in such a direction that the rotor shaft 43 extends horizontally.

The control unit 5 is composed of a circuit board 51 and a plurality of electronic components mounted on the circuit board 51. The control unit 5 operates using as its power source a DC voltage supplied to a terminal 50 of a connector unit 441 provided in the motor housing 44. The circuit board 51 is covered by a metal cover 500 attached to the motor housing 44. The plurality of electronic components include a central processing unit (CPU) and a switching element. The control unit 5 generates a motor current to be supplied to the electric motor unit 4 by pulse width modulation (PWM) control by turning on and off the switching element. In the present embodiment, the control unit 5 is integrated with the electric motor unit 4. However, the control unit 5 may be separated from the electric motor unit 4 and connected to the electric motor unit 4 by a cable.

As shown in FIG. 2, the pump unit 3 includes the circular plate-shaped inner rotor 31 including a plurality of external teeth 311 and the annular outer rotor 32 including a plurality of internal teeth 321. The inner rotor 31 is a rotating body that is rotationally driven by the electric motor unit 4. The inner rotor 31 is attached to the rotor shaft 43 so as not to be rotatable relative to the rotor shaft 43. In the present embodiment, the rotor shaft 43 is spline-fitted in the center of the inner rotor 31. In FIG. 1A, the rotation axis O of the rotor shaft 43 is shown by long dashed short dashed line. The inner rotor 31 is rotationally driven about the rotation axis O by the electric motor unit 4. Hereinafter, a direction parallel to the rotation axis O is sometimes referred to as the axial direction.

The number of internal teeth 321 of the outer rotor 32 is larger than that of external teeth 311 of the inner rotor 31 by one. The outer rotor 32 is disposed in the accommodating chamber 20 so as to be rotatable about a position eccentric from the center of rotation of the inner rotor 31. The inner rotor 31 defines a plurality of pump chambers 30 between the inner rotor 31 and the outer rotor 32 disposed on the outer peripheral side of the inner rotor 31. The plurality of pump chambers 30 are defined by the external teeth 311 of the inner rotor 31 and the internal teeth 321 of the outer rotor 32. The capacity of each pump chamber 30 changes with rotation of the inner rotor 31 and the outer rotor 32.

In the present embodiment, the pump unit 3 is configured as an inscribed gear pump. However, the disclosure is not limited to this, and the pump unit 3 may be configured as, for example, a vane pump. In this case, a rotor, which is a rotating body having radial slits accommodating a plurality of vanes, is rotationally driven by the electric motor unit 4. A plurality of pump chambers are defined on the outer peripheral side of the rotor by the vanes, and the capacity of each pump chamber changes with rotation of the rotor.

The pump housing 2 includes a first housing member 7 and a second housing member 8 and is fixed to the motor housing 44 by a plurality of bolts 66. When the pump device 1 is attached to the transmission case 10, the entire pump housing 2 is disposed in the transmission case 10. In the present embodiment, the pump housing 2 is fixed to the motor housing 44 by three bolts 66, and one of the bolts 66 is shown in FIG. 1A. Each bolt 66 is screwed into a nut member 67 molded in the motor housing 44.

The first housing member 7 is made of a die-cast metal. The first housing member 7 is a single-piece member composed of a disc-shaped body portion 71 including the accommodating chamber 20 in the center and a plurality of protruding portions 72 protruding radially outward from an outer peripheral surface 71*a* of the body portion 71. In the present embodiment, the first housing member 7 includes three protruding portions 72 that radially protrude, and each protruding portion 72 includes a bolt insertion hole 720 through which the bolt 66 is inserted. The first housing member 7 is disposed between the second housing member 8 and the motor housing 44, and a part of the first housing member 7 in the axial direction is fitted in the motor housing 44.

The first housing member 7 includes an insertion hole 70 in the center. The rotor shaft 43 is inserted through the insertion hole 70, and the tip of the rotor shaft 43 is disposed in a central hole 80 of the second housing member 8. The first housing member 7 holds an annular seal member 69, and the seal member 69 is elastically in contact with the rotor shaft 43.

Figure 3A:
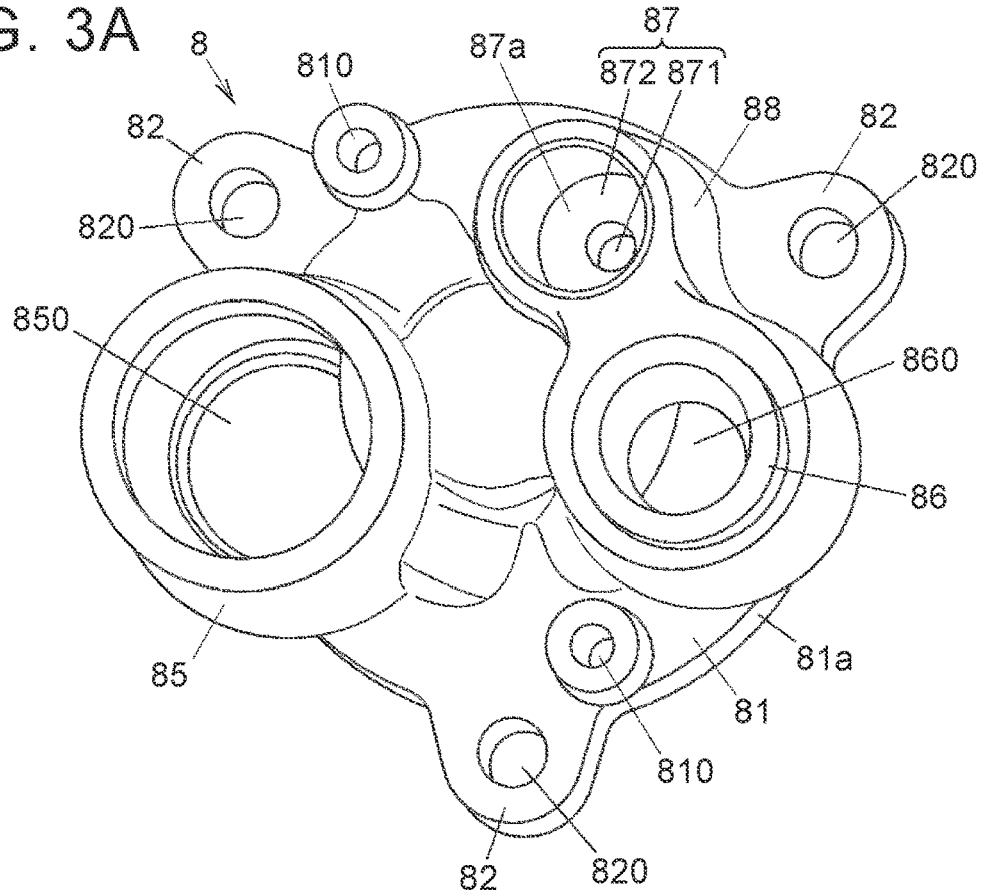
FIGS. 3A and 3B are perspective views of a second housing member, where
Figure 3B:
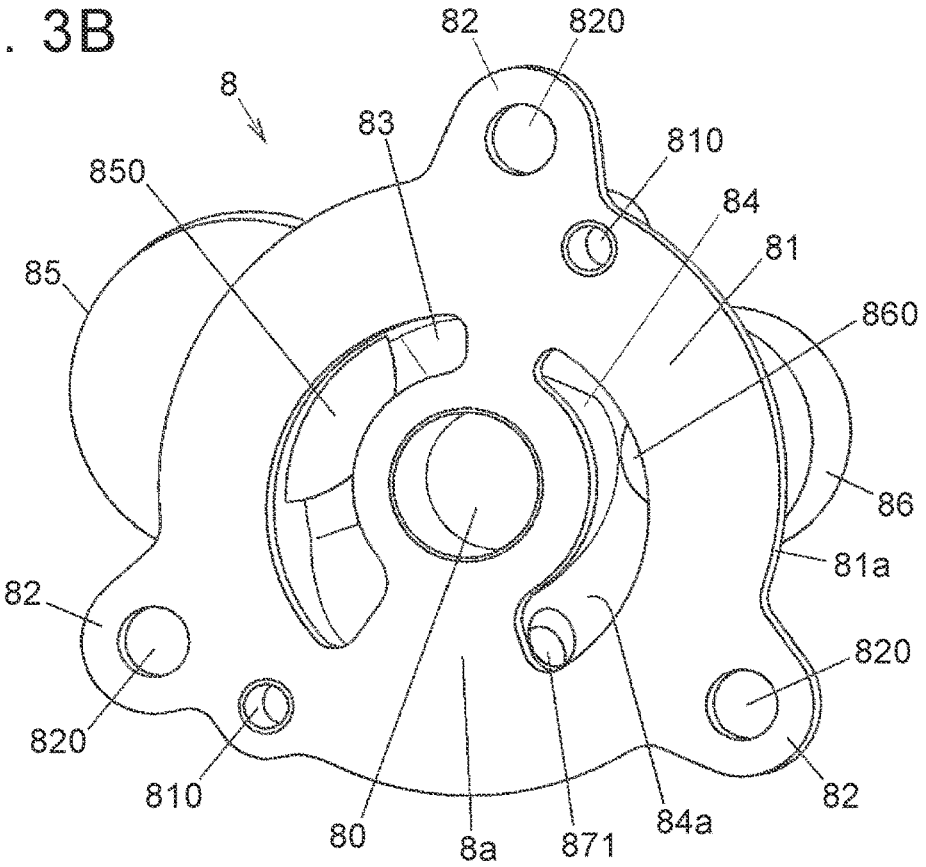
Figure 4A:
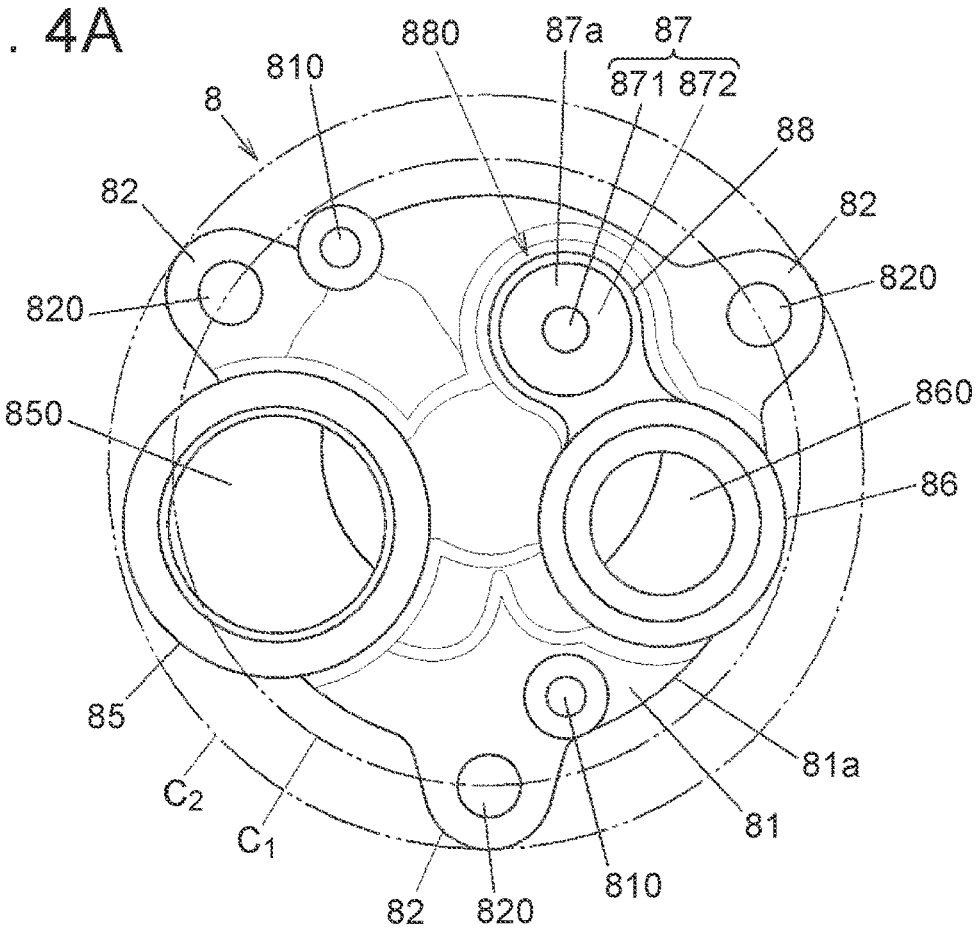
FIG. 4A illustrates the second housing member as viewed in the axial direction from the opposite side of the second housing member from the first housing member.
Figure 4B:
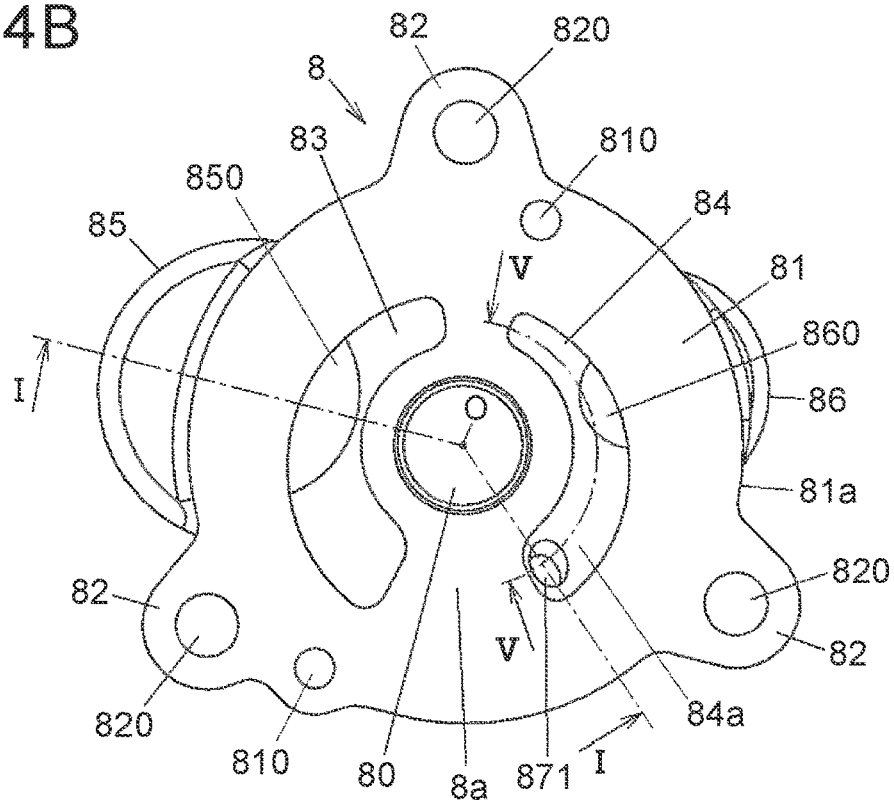
FIG. 4B illustrates the second housing member as viewed in the axial direction from the first housing side of the second housing member.

FIGS. 3A and 3B are perspective views of the second housing member 8. FIG. 3A illustrates the opposite surface of the second housing member 8 from the first housing member 7, and FIG. 3B illustrates the surface of the second housing member 8 that faces the first housing member 7. FIG. 4A illustrates the second housing member 8 as viewed in the axial direction from the opposite side of the second housing member 8 from the first housing member 7, and FIG. 4B illustrates the second housing member 8 as viewed in the axial direction from the first housing member 7 side of the second housing member 8. FIG. 1A shows a section taken along line 1-1 in FIG. 4B.

Like the first housing member 7, the second housing member 8 is made of a die-cast metal. The second housing member 8 is a single-piece member composed of a disc-shaped body portion 81 having the same diameter as the body portion 71 of the first housing member 7 and a plurality of protruding portions 82 protruding radially outward from an outer peripheral surface 81*a* of the body portion 81. In the present embodiment, like the first housing member 7, the second housing member 8 includes three protruding portions 82 that radially protrude, and each protruding portion 82 includes a bolt insertion hole 820 through which the bolt 66 is inserted. The metal material for the first housing member 7 and the second housing member 8 is suitably an aluminum alloy. However, the disclosure is not limited to this, and the metal material may be, for example, an iron-based metal.

The body portion 71 of the first housing member 7 and the body portion 81 of the second housing member 8 are positioned relative to each other in the radial and circumferential directions by two positioning pins 60 (see FIG. 2). The body portion 71 of the first housing member 7 includes fitting holes 710 at two positions with the accommodating chamber 20 interposed therebetween, and the two positioning pins 60 are fitted in the fitting holes 710. Similarly, the body portion 81 of the second housing member 8 includes fitting holes 810 at two positions, and the two positioning pins 60 are fitted in the fitting holes 810.

The body portion 81 of the second housing member 8 includes a suction port 83 and a discharge port 84 that are open to the accommodating chamber 20. The suction port 83 and the discharge port 84 are in a shape of an arc-shaped grooves and extend in the rotation direction of the inner rotor 31 and the outer rotor 32. The suction port 83 and the discharge port 84 are recessed in the axial direction from a flat surface 8*a* of the second housing member 8 that faces the first housing member 7.

In a suction stroke in which the capacity of the pump chamber 30 increases, oil flows from the suction port 83 into the pump chamber 30. In a discharge stroke in which the capacity of the pump chamber 30 decreases, oil flows out of the pump chamber 30 into the discharge port 84. The pump unit 3 thus sucks oil from the suction port 83 and discharges the sucked oil from the discharge port 84 by the pump operation composed of the suction stroke and the discharge stroke.

The second housing member 8 includes a cylindrical suction pipe portion 85. A hollow portion of the suction pipe portion 85 serves as a suction flow path 850 that guides oil into the suction port 83. The second housing member 8 further includes a cylindrical discharge pipe portion 86. A hollow portion of the discharge pipe portion 86 serves as a discharge flow path 860 that guides oil from the discharge port 84 to the outside. The suction pipe portion 85 and the discharge pipe portion 86 protrude in the axial direction from the body portion 81. The pump device 1 sucks oil into the suction flow path 850 and supplies the sucked oil from the discharge flow path 860 to an object to which oil is to be supplied.

The pump device 1 further includes a relief valve 9 that opens when the hydraulic pressure (oil pressure) in the discharge port 84 becomes equal to or larger than a predetermined value. When the relief valve 9 opens, a part of oil having flowed from the pump chamber 30 into the discharge port 84 in the discharge stroke is discharged to the low-pressure side without being supplied to the object to which oil is to be supplied. In the present embodiment, when the relief valve 9 opens, a part of the oil in the discharge port 84 is discharged to the oil pan. However, a flow path may be provided such that a part of the oil is discharged to the suction flow path 850.

The relief valve 9 includes a valve body 91, a coil spring 92, and a snap ring 93. The coil spring 92 is a biasing member that biases the valve body 91 in the valve closing direction. The coil spring 92 is in contact with the snap ring 93. In the present embodiment, the valve body 91 is spherical, and the coil spring 92 is compressed between the valve body 91 and the snap ring 93. In the present embodiment, the coil spring 92 has the shape of a partial cone having smaller inside diameter as getting closer to its end contacting the valve body 91.

The second housing member 8 includes a relief flow path 87 that is open to a groove bottom surface 84*a* of the discharge port 84. When the relief valve 9 opens, oil flows from the discharge port 84 to the low-pressure side through the relief flow path 87. The relief flow path 87 is composed of a small diameter hole 871 and a large diameter hole 872 that communicate with each other. The small diameter hole 871 is provided on the discharge port 84 side. The inside diameter of the small diameter hole 871 is smaller than the diameter of the valve body 91, and the inside diameter of the large diameter hole 872 is larger than the diameter of the valve body 91. The step surface between the small diameter hole 871 and the large diameter hole 872 is a tapered seating surface 87*a*. The valve body 91 contacts the tapered seating surface 87*a* due to the biasing force of the coil spring 92.

The relief flow path 87 includes an opening 87*b* provided in the groove bottom surface 84*a* of the discharge port 84.

The valve body 91, the coil spring 92 and the opening 87*b* of the relief flow path 87 are arranged in the axial direction and the valve body gland the coil spring 92 are accommodated in the large diameter hole 872 of the relief flow path 87. The large diameter hole 872 is provided in the second housing member 8. Specifically, the large diameter hole 872 is provided in a tubular portion 88 including the relief flow path 87 therein. The tubular portion 88 has a cylindrical shape and has the large diameter hole 872 in the center. The tubular portion 88 accommodates the valve body 91 and the coil spring 92, and the snap ring 93 is press-fitted in the opening end of the tubular portion 88. The snap ring 93 is in the shape of a ring. When the relief valve 9 opens, oil is discharged from the inside of the snap ring 93 into the oil pan.

As shown in FIG. 1B, when the hydraulic pressure in the discharge port 84 is less than a predetermined value, the valve body 91 is in contact with the seating surface 87*a* due to the urging force (restoring force) of the coil spring 92, and the relief valve 9 is in a closed state. As shown in FIG. 1C, when the hydraulic pressure in the discharge port 84 becomes equal to or higher than the predetermined value, the coil spring 92 is compressed and the valve body 91 is withdrawn. The relief valve 9 is thus opened with the valve body 91 separated from the seating surface 87*a*. Oil therefore flows through the clearance between the valve body 91 and the seating surface 87*a* into the large diameter hole 872.

The coil spring 92 extends and contracts along the central axis C (shown in FIG. 1A) of the tubular portion 88. In the present embodiment, the central axis C of the tubular portion 88 is parallel to the rotation axis O of the rotor shaft 43, and the direction in which the coil spring 92 extends and contracts is a direction parallel to the rotation axis O of the rotor shaft 43. The central axis C of the tubular portion 88 and the direction in which the coil spring 92 extends and contracts may be slightly tilted with respect to the rotation axis O. In other words, the central axis C of the tubular portion 88 and the direction in which the coil spring 92 extends and contracts need only be substantially parallel to the rotation axis O.

As shown in FIG. 4A, when the second housing member 8 is viewed in the axial direction, the tubular portion 88 is entirely located radially inward of the outer peripheral surface 81*a* of the body portion 81. In other words, the tubular portion 88 does not protrude radially outward beyond the outer peripheral surface 81*a* of the body portion 81 when the second housing member 8 is viewed in the axial direction. The tubular portion 88 is less likely to interfere with constituent members in the transmission case 10. The central axis C may be tilted with respect to the rotation axis O within such a range that the tubular portion 88 does not protrude radially outward beyond the outer peripheral surface 81*a* of the body portion 81 when the second housing member 8 is viewed in the axial direction (within such a range that the tubular portion 88 is entirely located radially inward of the outer peripheral surface 81*a* of the body portion 81 when the second housing member 8 is viewed in the axial direction). Interference of the tubular portion 88 with the constituent members in the transmission case 10 is easily avoided when the tilt of the central axis C with respect to the rotation axis O is within this range.

The tubular portion 88 is located inwardly of a pitch circle $C_1$ passing through the center points of the plurality of bolt insertion holes 820 and an outside diameter circle $C_2$ indicating an outer peripheral surface 4*a* of the electric motor unit 4 (the outside diameter of a portion of the motor housing 44 that surrounds the stator core 41). With this configuration, it is not necessary to increase the size of the opening 100 in order to insert the tubular portion 88 into the opening 100 of the transmission case 10.

Figure 5:
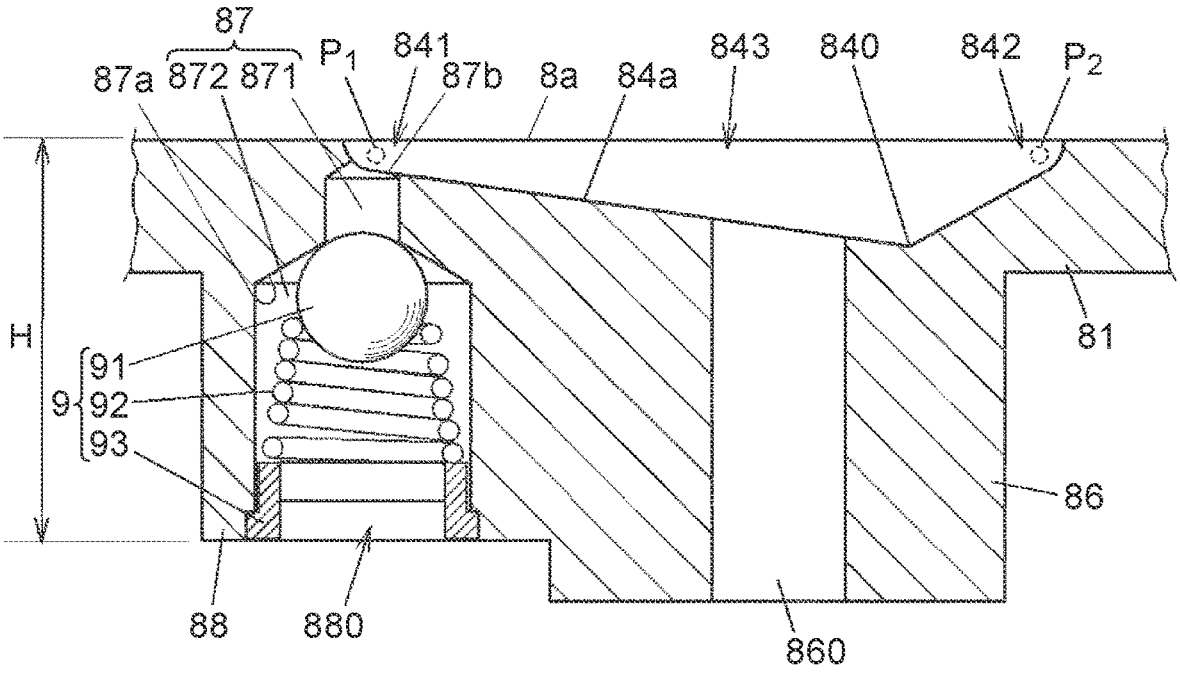
FIG. 5 is a sectional view of the second housing member and a relief valve taken along line V-V in FIG. 4B.

FIG. 5 is a sectional view of the second housing member 8 and the relief valve 9 taken along line V-V in FIG. 4B, namely in the direction in which the discharge port 84 extends. The discharge port 84 includes a start end 841, a terminal end 842, and a middle portion 843. The start end 841 is one end in the direction in which the discharge port 84 extends, and the pump chamber 30 communicates with the start end 841 in the initial stage of the discharge stroke. The terminal end 842 is the other end in the direction in which the discharge port 84 extends, and the pump chamber 30 communicates with the terminal end 842 in the final stage of the discharge stroke. The middle portion 843 corresponds to an intermediate position between the start end 841 and the terminal end 842. The discharge port 84 is shallower in the start end 841 and the terminal end 842 than in the middle portion 843. The discharge flow path 860 communicates with the discharge port 84 at a position near the middle portion 843. A deepest portion 840 of the discharge port 84 is located closer to the terminal end 842 than the middle portion 843.

The opening 87*b* of the relief flow path 87 is provided in the groove bottom surface 84*a* of the start end 841 of the discharge port 84. The groove bottom surface 84*a* between the start end 841 and the middle portion 843 of the discharge port 84 is tilted such that the axial depth of the discharge port 84 gradually increases from the start end 841 toward the middle portion 843. The groove bottom surface 84*a* may be configured such that the axial depth of the discharge port 84 increases stepwise from the start end 841 toward the middle portion 843. When the groove bottom surface 84*a* is such a tilted surface that the axial depth of the discharge port 84 gradually increases from the start end 841 toward the middle portion 843, oil flows smoothly in the discharge port 84.

As described above, the opening 87*b* of the relief flow path 87 is provided in the groove bottom surface 84*a* of the start end 841 of the discharge port 84 where the depth from the flat surface 8*a* is relatively shallow. In this case, the height H of the tubular portion 88 from the flat surface 8*a* is smaller than in the case where the opening 87*b* is provided, for example, near the middle portion 843. The tubular portion 88 is therefore less likely to interfere with the constituent members in the transmission case 10 in the axial direction of the pump device 1. The suction pipe portion 85 and the discharge pipe portion 86 are greater in height from the flat surface 8*a* than the tubular portion 88 is. However, since oil pipes are connected to the suction pipe portion 85 and the discharge pipe portion 86, interference of the suction pipe portion 85 and the discharge pipe portion 86 with the constituent members in the transmission case 10 need not be considered.

Figure 6:
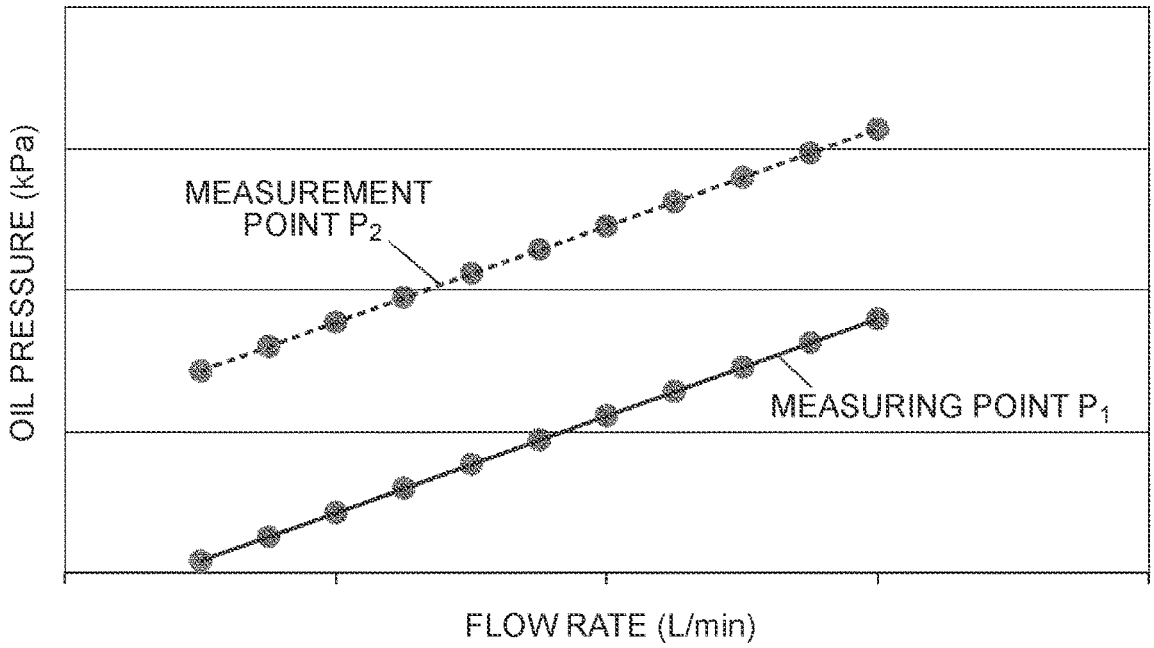
FIG. 6 is a graph showing the measurement results of the relationship between the oil flow rate and the oil pressures measured in one end and the other end of a discharge port.

FIG. 6 is a graph showing the measurement results of the relationship between the oil flow rate and the oil pressures measured at measurement points $P_1$, $P_2$ (shown in FIG. 5) in the start end 841 and the terminal end 842 of the discharge port 84 with the relief valve 9 closed. A hole with a small diameter was provided in the second housing member 8, and measurement was performed with a pressure sensor inserted into the discharge port through this hole. Pulsating instantaneous values were averaged and plotted on the graph.

As shown in FIG. 6, for both the measurement point $P_2$ in the terminal end 842 and the measurement point $P_1$ in the start end 841, the oil pressure increases as the oil flow rate increases. At any flow rate, the oil pressure at the measurement point $P_2$ is higher than that at the measurement point $P_1$. This pressure difference between the measurement point $P_2$ and the measurement point $P_1$ is considered to be an amount corresponding to an increase in pressure that is caused when oil having flowed out of the pump chamber 30 with rotation of the inner rotor 31 hits the inner surface of the discharge port 84 on the terminal end 842 side etc. due to the inertia of the oil.

In order to appropriately open the relief valve 9 according to the discharge pressure of oil, it is desirable to minimize the influence of the increase in pressure caused by the inertia of the oil flow such that the relief valve 9 does not open due to this increase in pressure. In present embodiment, since the opening 87*b* of the relief flow path 87 is provided in the groove bottom surface 84*a* of the start end 841 of the discharge port 84, the valve body 91 receives a reduced dynamic pressure of oil, and the relief valve 9 opens at an appropriate pressure set by the spring constant and the amount of compression of the coil spring 92.

Effects of Embodiment

According to the above embodiment, the relief flow path 87 is open to the groove bottom surface 84*a* of the start end 841 of the discharge port 84, and the valve body 91, the coil spring 92 and the opening 87*b* of the relief flow path 87 are arranged in the direction parallel to the rotation axis O. With this configuration, reduction in size of the pump device 1 is achieved, mountability of the pump device 1 on vehicles etc. is improved, and the relief valve 9 is appropriately opened according to the discharge pressure of oil. According to the above embodiment, the valve body 91 and the coil spring 92 are disposed in the relief flow path 87. With this configuration, it is not necessary to secure a space for accommodating the valve body 91 and the coil spring 92 separately from the relief flow path 87, and further reduction in size of the pump device 1 is achieved.

Although the disclosure is described above based on the embodiment, the embodiment is not intended to limit the disclosure according to the claims.

The disclosure may be modified as appropriate without departing from the spirit and scope of the disclosure. For example, the above embodiment is described with respect to the case where the pump device 1 is mounted on a vehicle and attached to the transmission case 10. The object to which the pump device 1 is to be attached need not necessarily be a transmission. The pump device 1 may be used in applications other than vehicles.

What is claimed is:

1. A pump device, comprising:

a rotating body that is rotationally driven about a rotation axis;

a pump housing including a suction port and a discharge port that are open to an accommodating chamber accommodating the rotating body, the suction port and the discharge port extending in a shape of an arc-shaped groove; and a relief valve that opens when a hydraulic pressure in the discharge port becomes equal to or higher than a predetermined value, wherein:

in the pump device, a fluid is sucked from the suction port and discharged from the discharge port by rotation of the rotating body;

the relief valve includes a valve body and a biasing member that biases the valve body in a valve closing direction;

the discharge port includes a start end in a direction in which the discharge port extends, a terminal end, and a middle portion, the start end and the terminal end being shallower than the middle portion of the discharge port, and a deepest portion of the discharge port being located closer to the terminal end than the middle portion;

the pump housing includes a relief flow path through which the fluid flows when the relief valve opens, the relief flow path being provided so as to be open to a groove bottom surface of the start end of the discharge port;

the valve body and the biasing member of the relief valve and an opening of the relief flow path are arranged in a direction parallel to the rotation axis, the opening of the relief flow path being provided in the groove bottom surface; and the groove bottom surface between the start end and the middle portion is tilted such that an axial depth of the discharge port increases from the start end toward the middle portion.

2. The pump device according to claim 1, wherein the rotating body defines a plurality of pump chambers on an outer peripheral side of the rotating body, each of the pump chambers having a capacity that changes with rotation of the rotating body, the pump device performs a pump operation in which the fluid flows from the suction port into each of the pump chambers in a suction stroke in which the capacity increases and the fluid flows from each of the pump chambers into the discharge port in a discharge stroke in which the capacity decreases, and the GM start end of the discharge port is an end with which each of the pump chambers communicates in an initial stage of the discharge stroke.

3. The pump device according to claim 1, wherein the depth of the discharge port gradually increases from the start end toward the middle portion.

4. The pump device according to claim 1, wherein the biasing member is a coil spring, and a direction in which the coil spring extends and contracts is substantially parallel to the rotation axis.

5. The pump device according to claim 1, wherein the pump housing includes a disc-shaped body portion including the suction port and the discharge port, a tubular portion including the relief flow path inside the tubular portion is provided in the body portion, the tubular portion accommodates the valve body and the biasing member, and the tubular portion is entirely located radially inward of an outer peripheral surface of the body portion when the pump housing is viewed in a direction of the rotation axis.

6. The pump device according to claim 4, further comprising an electric motor unit that rotationally drives the rotating body, wherein the rotating body is attached to an output rotating shaft of the electric motor unit, the coil spring is accommodated in a tubular portion, and the tubular portion is entirely located radially inward of an outer peripheral surface of the electric motor unit when the pump housing is viewed in a direction of the rotation axis.

7. The pump device according to claim 2, wherein the terminal end of the discharge port is an end with which each of the pump chambers communicates in a final stage of the discharge stroke.

8. The pump device according to claim 5, wherein the pump housing includes a suction pipe portion protruding axially from the body portion and including a hollow portion serving as a suction flow path that guides the fluid into the suction port, and a discharge pipe portion protruding axially from the body portion and including a hollow portion serving as a discharge flow path that guides the fluid from the discharge port to an outside, wherein the suction port and the discharge port are recessed in an axial direction from a flat surface of the pump housing, and wherein the suction pipe portion and the discharge pipe portion are greater in height from the flat surface of the pump housing than the tubular portion.

* * * * *